US006741175B1

(12) United States Patent
Rauch

(10) Patent No.: US 6,741,175 B1
(45) Date of Patent: May 25, 2004

(54) MASS TRANSPORTATION PASSENGER GUIDANCE SYSTEM

(76) Inventor: Jurgen Rauch, Helene-Weber-Alloe 16, 80637 Munich (DE)

( * ) Notice: Subject to any disclaimer, the term of this patent is extended or adjusted under 35 U.S.C. 154(b) by 0 days.

(21) Appl. No.: 09/308,941

(22) PCT Filed: Nov. 28, 1997

(86) PCT No.: PCT/EP97/06645

§ 371 (c)(1),
(2), (4) Date: May 27, 1999

(87) PCT Pub. No.: WO98/24072

PCT Pub. Date: Jun. 4, 1998

(30) Foreign Application Priority Data

Nov. 28, 1996 (DE) ..... 196 49 280

(51) Int. Cl.[7] ..... G08B 13/00

(52) U.S. Cl. ..... 340/541; 340/545.2; 340/555; 340/556; 340/557; 340/426

(58) Field of Search ..... 340/541, 545.2, 340/555, 556, 557, 426

(56) References Cited

U.S. PATENT DOCUMENTS

| | | | | | |
|---|---|---|---|---|---|
| 4,278,878 | A | * | 7/1981 | Kato | 235/92 PK |
| 4,528,679 | A | * | 7/1985 | Shahbar et al. | 377/6 |
| 4,794,373 | A | * | 12/1988 | Harrison | 340/286 R |
| 5,485,347 | A | * | 1/1996 | Miura | 364/557 |
| 5,669,588 | A | * | 9/1997 | Goldsmith | 246/307 |
| 5,920,057 | A | * | 7/1999 | Sonderegger et al. | 235/384 |

* cited by examiner

*Primary Examiner*—Daniel J. Wu
*Assistant Examiner*—Tai T. Nguyen
(74) *Attorney, Agent, or Firm*—J. Herbert O'Toole; Nexsen Pruet, LLC

(57) ABSTRACT

Device for guiding flows of individuals in mass transportation systems, containing at least the following components: A) a guidance system in embarking and disembarking areas interacting with at least one of the following devices: a) a guidance system in the means of transportation. b) a blocking device between the embarking/disembarking areas and the means of transportation.

12 Claims, 4 Drawing Sheets

MASS TRANSPORTATION PASSENGER GUIDANCE SYSTEM

BACKGROUND OF THE INVENTION

1. Field of the Invention

The invention relates to a device for the guidance of streams of individuals using traffic systems and furthermore the use thereof for the guidance of streams of individuals using traffic systems and furthermore to a method for the guidance of streams of individuals using the above mentioned device.

2. Description of the Prior Art

In the case of publicly used traffic systems, more particularly traffic systems such as railroads, urban railroads and subways there is the necessity to make the most efficient possible use of such traffic systems. As regards the efficient use of such traffic systems stations and the platforms thereof—that is to say the regions where embarking and filling and emptying of the means of transportation takes place—play a particularly important role. In this connection a particularly decisive point is the desired best possible and particularly preferred even distribution of the individuals, more particularly the passengers on the platform along the traffic system, preferably along the train. This distribution must for its part take place in a manner dependent on the numerical individual flow rate within the traffic system. By optimum distribution of the individuals along the traffic system it is possible to achieve a minimization of the halt time of the means of transportation, because the emptying and filling of the means of transportation may then take place in the shortest possible time.

The only systems presently known for the guidance of streams of passengers are the indications provided, for example in subways, urban railroads and regional train regions as to whether a short train or a long train is being used. Such particulars render it possible for the passenger to stand in a region in which the train will halt. Furthermore it is a known practice to use by shining arrows to indicate to the passengers on a train which side of the train the platform in the next station will be on. Furthermore in the case of long distance trains there are tables of train composition to show in which part of the train the first and, respectively, the second class cars are located or in which part of the train, that is to say in which car, a seat he has booked is located. In the case of these system it is a question of static systems, which do not react to the number of passengers. They do not guide the stream of passenger dynamically, that is to say a manner dependent on the number of passengers.

So far no systems have become known for dealing with a large number of passengers which render it possible to distribute the passengers in a desired fashion or optimum fashion and preferably evenly over the platform or along a train in order to reduce the times of embarking and disembarking and therefore the halting time of the train. The result of this are substantial losses of time on embarking and disembarking, which summated for several stations mean a significant extension of the time traveling. Making the halting time shorter would thus lead to an enormous saving in time and comfort for the passengers and a substantially improved utilization and increase of capacities for stations and means of transportation. Simultaneously the more rapid movement of passengers from and onto a platform or, respectively, station would be rendered possible. This optimization of capacity means that traffic systems so far existing may be employed to more advantage, something which means that the expensive building of new or further extension of existing traffic systems may take place later or not at all despite the higher numbers of passengers and accordingly substantially less resources will be needed, there also being a reduction in costs and less impairment of the environment.

Enclosure 1

The German patent publication 2,645,352 C1 discloses an arrangement for the regulation of an embarking and disembarking passenger flow at stations, wherein vehicles and along the platform in the halt zone of the trains optical indicating means are arranged. In the case of this arrangement there is the danger that the passengers, who have taken up positions in accordance with the indicating means, might be hit by trains arriving at the station.

The U.S. Pat. No. 5,176,082 discloses a gate device which divides a platform into a section remote from and adjacent to a train door, because such gate device forms a square, and is arranged in front of the train. This involves the danger that waiting passengers might be hit by the train arriving at the station. Furthermore the regulation of the flow of passengers with gates of this type is impractical.

BRIEF SUMMARY OF THE INVENTION

Accordingly one object of the invention is to provide a device and a method, with which individual streams, and more particularly a large number, of passengers can be guided at low costs, efficiently and safely.

This object resulting from the above comprises the device for the guidance of individual streams in the case of traffic systems, which have at least as components thereof a guide system in the filling and emptying region in connection with at least one of the following means

- a guide system in the means of transportation guide system in the filling and emptying region in connection with at least one of the following means
- a guide system in the means of transportation
- a blocking means between the filling and emptying region on the one hand and the means of transportation on the other hand.

In the case of one preferred embodiment the device for guiding individual streams in the case of traffic systems comprises at least one guide system in the filling and emptying region and a guidance means in the means of transportation on the other hand.

In the case of one preferred embodiment of the invention the device for guiding individual streams in the case of traffic systems comprises at least one guide system in the filling and emptying region and a guide system and the means of transportation on the other hand.

In the case of another preferred embodiment of the invention the device for the guidance of individual streams in the case of traffic systems comprises at least one guide system in the filling and emptying region and a gate means between the filling and emptying region and the means of transportation.

In the invention the term individual streams or individuals is generally taken to mean living organisms, that is to say humans and animals. Human individual streams means more particularly streams of passengers in urban railroads, subways and railroads and furthermore magnetic levitation railroads and elevated railroads or the like. In the invention individual streams are particularly streams of passengers in urban railroads, subways, and railroads, more especially subways. In the invention individual streams may however also be vehicles steered by humans as are encountered in special car transporting trains.

In accordance with the invention means of transportation shall mean urban railroads, subways, tramways, regional railroads, magnetic levitation railroads, high speed railroads, elevated railroads, urban railroads, subways and railroads being preferred and subways being more particularly preferred. The means of transportation in accordance with the invention preferably comprise a track, filling and emptying region and means of transportation.

In accordance with the invention the term track shall mean a device, on which the means of transportation moves along a distance between two filling and emptying regions. Tracks preferred in accordance with the invention are rails in the case of the wheel rail system, monorails systems, tracks of track systems on rubber wheel and track of levitated or magnetic levitation railroads as for example the transrapid.

Means of transportation in accordance with the invention are in addition to the trains of the above mentioned means of transportation preferably trains of urban railroads, subways the railroad and also of magnetic levitation railroads, and railroads and elevated railroads. The trains in accordance with the invention may comprises one or more train parts, and preferably railroad cars, which are either motorized or are driven by one or more external drive systems, preferably drive heads, as for example locomotives.

The term filling and emptying region shall preferably mean the region, which must be passed in order to embark on or disembark from the means of transportation. Filling and emptying regions particularly preferred in accordance with the invention are those which adjoin the openings for filling and emptying the means of transportation. Particularly preferred filling and emptying regions are platforms of urban railroads, subways the railroads and furthermore magnetic levitation railroads, railroads using levitation as such elevated railroads. Of such platforms again those regions are particularly preferred, which adjoin the openings for filling and emptying the means of transportation. Such regions are preferably the regions, adjoining the platform or vestibule edge, of the platforms or vestibules, which adjoin, preferably in the vicinity of the train or, respectively, train part, preferably the railroad car, where the inlets and outlet and more particularly the train doors are located.

In accordance with the invention the filling and emptying region may have a guidance system. It is also preferred in the invention for the means of transportation to possess a guidance system. In accordance with the invention it is more particularly preferred for both the filling and emptying region and also the means of transportation respectively possess a guidance system.

The purpose of the guidance system in accordance with the invention is to distribute the individuals or, respectively, the individual stream over the means of transportation so that the dwell time of the means of transportation in the filling and emptying region is as short as possible.

A preferred guidance system in the invention is an optical guidance system making use of optical means for meeting the above mentioned purpose. Optical means preferred in accordance with the invention of this optical guidance system are illuminated areas, preferably in different colors and configurations. The optical guidance systems are preferably in the form of a directional arrow and/or in the form of areas of different color. Furthermore preferably optical guidance system the form of directional arrows have areas and forms changing in their coloration and form, preferably denoting another direction of movement. It is furthermore preferred in the optical guidance systems of the invention for the arrows and preferably the colors of the areas to have a particular indicating function. Thus for instance a red area arranged in the filling and emptying region in front of means of transportation can mean that such area is reserved for individuals leaving the means of transportation. Furthermore an area in another color and/or form, preferably green, may mean that individuals may enter such area or may wait thereon in order to enter the means of transportation. The optical guidance systems in accordance with the invention in arrow forms may for example in the filling and emptying region indicate the way to the means of transportation and thus indicate to the individual stream that it should board the means of transportation at this point. Optical guidance systems in accordance with the invention in the form of arrows in the filling and emptying region, which point away from the means of transportation, may indicate to the individual stream that this region is reserved for individuals, which are leaving the means of transportation. Further preferred optical guidance systems in accordance with the invention are those of a combination of illuminated, and preferably colored, areas and indicating arrows. The term "indicating arrows" is to mean not only indicating signs in the form of arrows but also all signs which are suitable for indicating the direction or generally for guidance of the individual stream. Instead of indicating arrows it is however possible also to provide other signs and/or combinations thereof, which indicate the embarking and disembarking regions to the individuals.

The guidance systems in accordance with the invention are accordingly devices, which are suitable for supplying the individuals in the individual stream with information, preferably optical information in order to evenly distribute them in the filling and emptying region along the means of transportation for regulation of the dwell time in the desired manner, preferably for reducing the dwell time of the means of transportation in a optimum fashion and preferably evenly.

In accordance with the invention those optical guidance systems are particularly preferred in the form of illuminated differently colored areas changing their coloration with or without indicating arrows, which are let into the floor of the filling and emptying region and preferably in the platform or vestibule floor.

Furthermore optical guidance systems are particularly preferred, which are arranged in the top part of the gate means and preferably over the openings of same and more particularly over the doors.

Furthermore it is particularly preferred in accordance with the invention for the means of transportation to have a guidance system, preferably an optical guidance system, and more more especially in the form of areas which are illuminated, colored, preferably with changing colors and furthermore more particularly possesses indicating arrows. It is more especially preferred for such guidance system to be so arranged in the means of transportation that it may be seen by all individuals present in the means of transportation. Furthermore it is preferred for this guidance system to be so arranged in the means of transportation that more particularly the individuals, who are leaving the means of transportation, are so distributed by the guidance system that emptying of the means of transportation takes place without any delay in time. In accordance with the invention particularly preferred the optical guidance in the means of transportation systems include colored areas with changing colors and indicating arrows, which are preferably at the level of the heads of the passengers. In lieu of indicating arrows it is however possible to provide other signs and/or sign combinations, which indicate the embarking and disembarking regions to the individuals.

Optical guidance system in accordance with the invention are preferably in the form of illuminated areas, and more particularly those composed of a plurality of individual light dots, which may change their coloration and making up illuminated areas so that a variation of the light, luminosity and color of the individual light point may be produced as geometrical figures, as for example arrows and indicating signs, and furthermore signs and/or combinations thereof, preferably lettering and more particularly pictograms, which are suitable to provide the guidance systems with information about a dedication for guidance of the individual streams.

Dedications are in accordance with the invention physical manifestations of directions or, respectively, information for individuals, such as preferably "wait", "go", "do not enter", "leave free", "distribute" and "leave" or the like.

Gate means in accordance with the invention arranged between the filling and emptying region on the one side and the means of transportation on the other side are preferably sheet-like structures, which are arranged along the line between the filling and emptying region on the one side and means of transportation on the other side. These preferably vertically arranged sheet-like structures preferably have at least one or more openings able to be closed. It is furthermore preferred in accordance with the invention for such sheet-like structures to be transparent and for example consist of transparent materials such as glass, transparent polymers, for instance acrylic glass, wire netting or knitted wire and grids.

Gate means in accordance with the invention which are particularly preferred have a plurality of transparent sheets able to be slid in relation to each other so as to open and close openings, such sheets being preferably of acrylic glass or glass or other transparent polymers. Sheets preferred in accordance with the invention are preferably metal framed. Such sheets are driven by drive means. Examples of drive means preferred in accordance with the invention are electrically operated ones, for example those driven by electric motors or electric magnets and furthermore hydraulic ones driven by liquid or gas pressure, preferably by oil pressure or air pressure. The drive means for the sheets of the gate means are preferably so arranged that they are not visible. Accordingly an arrangement in the ceiling or, respectively, in the floor of the filling and emptying region is preferred. In accordance with the invention gate means are particularly preferred comprising relatively sliding transparent sheets, which clear openings and close same, and which are arranged along a platform or vestibule edge and preferably are able to uncover openings, which correspond to the openings of the means of transportation.

It is furthermore preferred in accordance with the invention for such gate means to be so arranged with the guidance system arranged in the filling and emptying region and with the guidance system in the means of transportation and also with the openings in the means of transportation that the dwell time of the means of transportation is kept as short as possible. This is preferably then the case when the openings provided for filling and the openings provided for emptying in the means of transportation are aligned with corresponding openings in the gate means and with corresponding guidance systems in the means of transportation and the filling and emptying region and owing to the cooperation thereof so guide the individual stream that the dwell or stopping time of the means of transportation is as short as possible.

Furthermore the device of the invention for the guidance of individual streams preferably comprises a control unit. This control unit detects the individual stream or, respectively, the changes in the individual stream and interprets same as commands for the guidance system or, respectively, for changing the direction for guidance of the guidance systems for the individuals in the individual stream for guiding the individual stream to reduce the dwell time of the means of transportation in the filling and emptying region and for optimizing the transit paths and transit time of the individuals in the filling and emptying region. The control unit in accordance with the invention preferably comprises a detecting means, processing means, and if necessary a command means, which each comprise hardware and software, and preferably the processing means comprises a computer and a corresponding program for processing the data obtained to interpret same to produce commands. The detecting means is preferably a means for counting the individuals per unit time for determining the individual stream, for example photoelectric detectors. The detecting means in the filling and emptying regions without daylight, as for example underground stations, is preferably arranged in a region, which individual stream passes, when it makes its way from the filling and emptying region. It is furthermore preferred to arrange the counting means of the detecting means in the filling and emptying region in such a manner that number of individuals in the filling and emptying region may be determined as a function of time as a flow rate. This may preferably be done by arranging light sources in the floor of the filling and emptying region, preferably in combination with the optical guidance systems, such light sources being covered over to a greater or lesser extent so that more or less light passes to the sensors arranged above the filling and emptying region and preferably in the ceiling thereof. The individual density, i. e. the density of individuals, will then be indicated by the signal from the light sensors in a manner dependent on the intensity of the light which is incident. The reversed arrangement of the sensors and of the light sources is also possible given a suitable functionality. In this respect the standard intensity of illumination of the station is to be taken into account in making such determination. Furthermore as detection means it is also possible to have video and infrared cameras, with which the regions occupied by the individuals, more particularly the filling and emptying region, are at least partially scanned or. The pictures produced by the said cameras are evaluated using an individual recognition system for determination of the individual stream. Such an evaluation may for example in the case of the determination of humans be by counting heads both electronically by means of a suitable computer program and also by counting by staff employed for this purpose.

A processing means suitable in accordance with the invention preferably records signals, coming from the detecting means, for instance analog or digital signals. Such a processing means is in accordance with the invention preferably a computer. In this processing means the signals coming from the detection means are preferably processed by software in the form of a suitable computer program are worked to produced commands, which as signals, for example digital or analog ones and preferably digital ones, are passed on by the command means to the positions in the means of transportation or in the filling and emptying region or in the means of transportation and in the filling and emptying region, preferably to the regions producing the dedications, where the individual streams are to be guided.

In accordance with a further preferred device in accordance with the invention it is possible for at least one means associated with at one least filling and emptying region for detection of the individual stream in the filling and emptying region to allot information in relation to the individual stream to at least one processing means associated with the means for the detection of the individual stream in the filling and emptying, at least one means associated with at least one means of transportation, for detection of the numerical individual flow rate in the means of transportation can allot the numerical individual flow rate in the means of transportation to at least one processing means associated with the means for detection of the numerical individual flow rate in the means of transportation, the processing means being able to process the information into commands for at least one gate means between the filling and emptying region on the one hand and the means of transportation on the other hand or at least one guidance system in the filling and emptying region in the means of transportation or both for guidance of individual streams in the case of means of transportation.

Furthermore it is preferred for the processing means to constitute a functional unit. This is preferably the case, when the processing means of the individual filling and emptying region of a means of transportation are integrated with each other or the processing means constitutes a central unit, as for example a central computer.

In the processing means computer programs are preferably employed as software, which have algorithms, which process the signals or data coming from the detection means concerning the individual streams and the distribution thereof to produce at least one item of information, which using the command means, preferably in the form of a signal, is passed on to the positions in the means of transportation or in the filling and emptying region or in the means of transportation and in the filling and emptying region preferably to the regions producing the dedications, where the individual streams are to be guided in order to lead to the desired and preferably optimum distribution of the individuals.

In accordance with the invention it is preferably possible for other data as well, which have been found outside the detection means in accordance with the invention, to be transmitted to the processing means. In this respect it is a question preferably of data from passenger bookings or reservations for the respective means of transportation.

The command means may both be part of the control unit and also a part of the guidance system. If the device in accordance with the invention for the guidance of individual streams has a gate means, same may also comprise command means. In an embodiment, which is preferred in accordance with the invention, the command means is the section, which is arranged between the processing means of the control unit and the guidance system to connect same together. In this respect the command means transmits the information or, respectively, signals between the processing means and the guidance system and transforms the information or, respectively, signals of the processing means if necessary in such a manner that same may be interpreted by the guidance system to produce corresponding dedications having the individuals. Therefore it is preferred in accordance with the invention for the command means to comprise at least information transmission paths, preferably of electrical or optical conductors, preferably copper or glass fiber cable. Furthermore it is possible for a preferred embodiment of the command means to additionally have information processing means, preferably in the form of a computer, if need be with software adapted to the transformation of the information. Similarly it is possible for the detection means to be connected with the processing means of the control means.

The software in accordance with the invention preferably employed in the control means comprises algorithms, which so process the incoming data concerning the distribution states of the individuals in at least one means of transportation on the one hand and in at least one filling and emptying region that the individuals are distributed in the desired manner and preferably in an optimum manner along the means of transportation or in the filling and emptying region, preferably the means of transportation and the filling and emptying regions, which constitute a means of transportation of one or more paths or tracks. The software employed for a means of transportation has algorithms, which control the individual distribution over the entire means of transportation. In this connection the desired and preferably optimum distributions of individuals in the individual means of transportation and filling and emptying regions is a adapted to the entire traffic system. This can mean that in a certain filling and emptying region and/or in a certain means of transportation an individual distribution, which is not desired or not optimum, for this single means of transportation and/or filling and emptying region, may be tolerated in favor of a distribution in at least one other means of transportation and/or filling and emptying region of the traffic system, preferably of the entire traffic system. This manner of functioning is for example advantageous in the case of two filling and emptying regions located on a track, in the case of which the second filling and emptying regions coming second after the first filling and emptying region has a higher individual density than the first filling and emptying region. In this situation a non-optimum individual distribution is tolerated in the first filling and emptying region and in the two means of transportation, which render possible a better clearance of the individuals in the second filling and emptying region and consequently better operation of the entire traffic system. In order to minimize departures from the desired or optimum conditions of a single filling and emptying region and/or of a single means of transportation, it is preferred in accordance with the invention to distribute the non-optimum conditions over several filling and emptying regions and/or means of transportation of the traffic system as slight departures.

It is particularly preferred in accordance with the invention to have a device for the guidance of individual streams, in the case of which when the means of transportation is in the filling and emptying region, the components, i. e. the guidance system in the filling and emptying region or preferably the guidance system in the filling and emptying region and a gate means or more particularly the guidance system in the filling and emptying region, a gate means and a guidance system in the means of transportation or in addition to this preferably a guidance system in the filling and emptying region and in the means of transportation, are so arranged that same indicate in which sections of the means of transportation, i. e. preferably at which openings of the means of transportation, or more particularly at which train doors of the means of transportation they come into and/or leave the means of transportation.

In accordance with the invention it is furthermore preferred to have a device for the control of individual streams, more particularly for guidance of passengers in stations and trains, which has illuminated panels guiding the stream of passengers in the station region and in the train and between the edge of the platform and the train has platform gate means with doors.

Furthermore the invention relates to the use of the above described device for the control of individual streams in traffic systems.

Moreover the invention relates to a method for the control of individual streams in traffic systems which makes use of the above mentioned device.

A method in accordance with the invention for the control of individual streams in traffic systems, preferably mass traffic systems, is characterized in that by means of a device in accordance with the invention the individual stream in the filling and emptying region and the numerical individual flow rate in the means of transportation is measured and so processed that same are distributed in the desired fashion, preferably optimally, preferably evenly over the filling and emptying region.

In accordance with the invention an individual stream is to mean the amount of individuals in the traffic systems per time. The individual stream is formed by the numerical individual flow rate in the means of transportation and the flow of individuals in the filling and emptying region per time. The numerical individual flow rate is the number of the individuals in the means of transportation per unit time. Thus for example the individual stream is the greater the higher the number of individuals conveyed per time.

In accordance with the invention an optimum distribution is ensured, this meaning that the individuals in the corresponding components, i. e. in the filling and emptying region and, respectively, in the means of transportation, are so distributed that the dwell time of the means of transportation in the filling and emptying region is as short as possible. This may apply on the one hand for an individual filling and emptying region with one means of transportation or preferably for the complex system of at least two filling and emptying regions with at least one means of transportation connecting such filling and emptying regions—that is to say preferably for the individual station with an arriving train and for the complex system of a track with several stations and several trains. For this purpose it is necessary for the individuals for instance for embarking and disembarking to stand directly at the doors of the car and to be so distributed along the platform along the train that at all railroad car doors there are the same embarking and disembarking times. The distribution is optimum when the sum of the distributions of the individuals located in the filling and emptying region along the means of transportation and the individuals located in the means of transportation is constant along the length of the means of transportation. This is for example the case when the individuals are so unevenly distributed on the filling and emptying region that the uneven distribution of individuals in the means of transportation is compensated as an even distribution.

In the method in accordance with the invention the control unit, and more particularly the detection means, detects the individual stream moving toward the filling and emptying region and the numerical individual flow rate in the means of transportation. The detected individual streams or individual flow rates are so interpreted in the processing means for regulation of the guidance systems that the individuals are so guided on filling and emptying the means of transportation that the dwell time of the means of transportation in the filling and emptying region is as short as possible.

The method of the invention performed by the device of the invention is characterized in that it is dynamic. In the present context dynamic means the ability to adapt itself to ever new situations, which change in the course of time, and are here more especially the change with time of the individual stream and more particularly the individual stream in the filling and emptying region and in the means of transportation. This make take place both continuously and discontinuously. For a case in which it is discontinuous, i. e. in time segments in sequence, time segments are preferred, which are between the successively occurring filling and emptying operations of means of transportation arriving in the filling and emptying region. In accordance with the invention particularly preferred time periods are 5 seconds to 24 hours and preferably 10 seconds to 1 hour and more particularly 15 seconds to 20 minutes before the means of transportation arrives in the filling and emptying region.

BRIEF DESCRIPTION OF THE DRAWINGS

The present invention will now be described with reference to non-limiting working examples in connection with the drawings.

Figure 1:
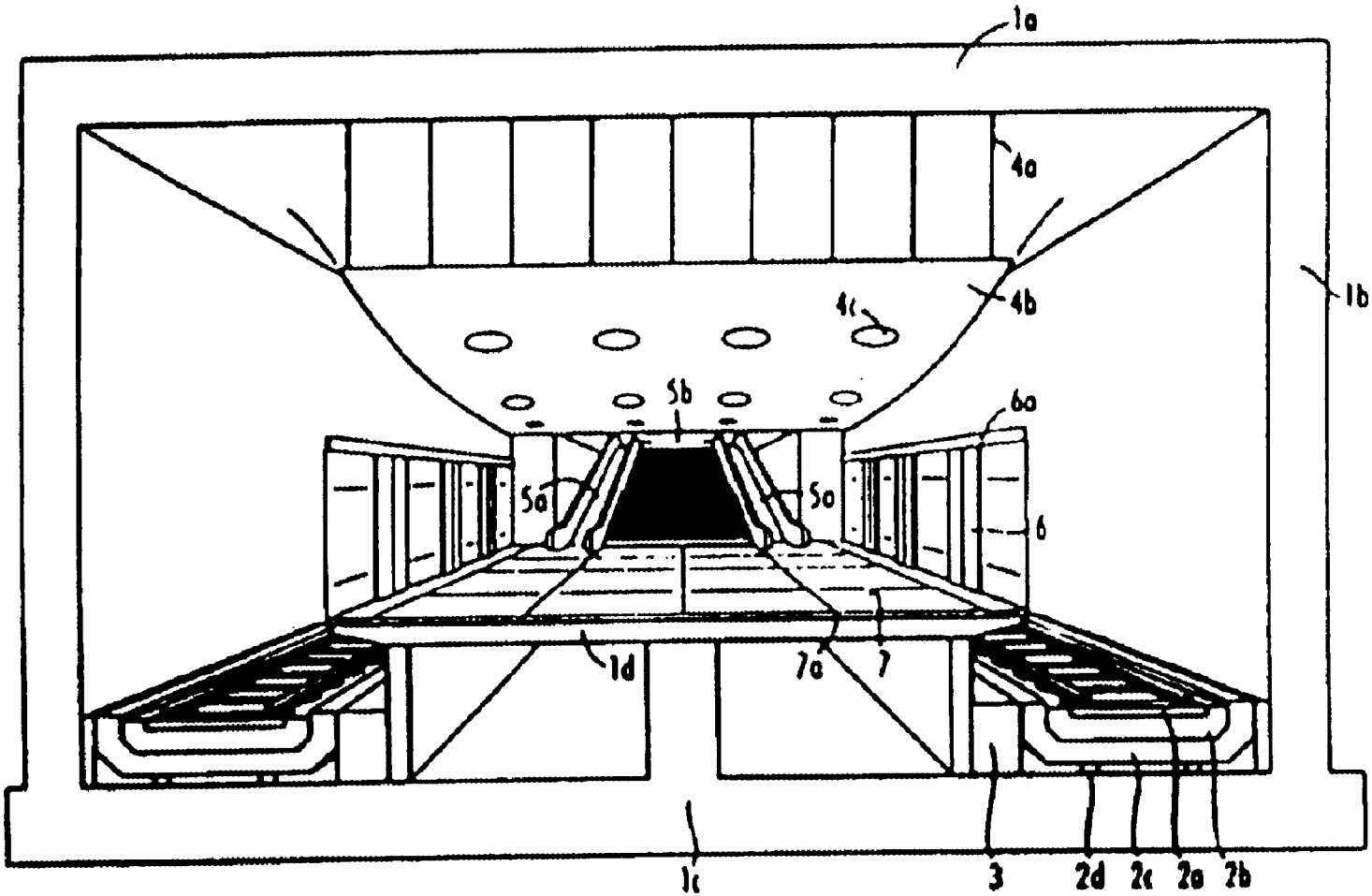
FIG. 1 shows a cross section through a station as an example.

A working example in accordance with the invention has in accordance with FIG. 1 a reinforced concrete tunnel ceiling 1.1*a,* a reinforced concrete tunnel wall 1.1*b,* a reinforced concrete tunnel floor 1.1*e,* a reinforced concrete platform slab 1.1*d,* a track comprising rails, elastically placed on concrete ties (wood ties also being possible) 1.2*a* a track bed in the form of a ballast or a ballast-free bed 1.2*b,* a reinforced concrete trough 1.2*c,* a Neopren bed 1.2*d,* 1.2*c* and 1.2*d* constituting a inertial-spring system for reducing structure-borne noise, a region for housing cables 1.3, suspended ceiling means 1.4*a,* a suspended ceiling, for example of aluminum, other metals or further non-inflammable material 1.4*b,* recesses, which may have both illuminating means and also in combination with the illuminating means or alone sensors of the detection means for determination of the individual stream 1.4*c,* moving staircase with detecting means for the determination of the individual stream, preferably photoelectric detectors 1.5*a,* fixed stairways with detecting means for the determination of the individual stream, preferably photoelectric detectors 1.5*b,* gate means as platform doors 1.6, guidance systems, preferably illuminated areas in the top region of the gate means 1.6*a* platform floor with illuminated areas for directing passengers to doors of flexible, transparent material for various purposes for the embarking and disembarking regions, embarking regions being used and disembarking regions being kept free of passenger 1.7, light source underneath the illuminating areas for operation of the illuminated areas 1.7*a.*

Using the detection means 1.5*a* and 1.5*b* located on the moving stairway and the fixed stairways the individual stream, referred to in the following as the passenger stream, of the passengers who arrive at and leave the platform, is detected. In the means of transportation the detection means determine the amount of passengers, who wish to disembark in the station of the example. By means of the control unit the optimum distribution of the persons on the platform is determined and using illuminated areas controlled by the command unit in the platform floor 1.7 by means of the light sources 1.7*a* and possibly by the illuminated areas 1.6*a* arranged in the top region of the gate means with the dedications of embarking and disembarking are indicated. After this the passengers are distributed in accordance with the dedications. In means of transportation, in the present case a subway train, the illuminated areas of the guidance system also indicate the embarking and disembarking regions, preferably the doors provided for embarking and disembarking and more particularly the doors provided either for embarking or for disembarking via the command means. After arrival of the subway train both the doors of this train and also accordingly the platform doors 1.6*c,* which are concealed, of the gate means open. The passenger enter or leave the subway train through doors denoted as an embarking and disembarking by the corresponding dedications. After the termination of embarking and disembarking operation the platform doors of the gate means are closed and the subway train leaves the station.

Figure 2:
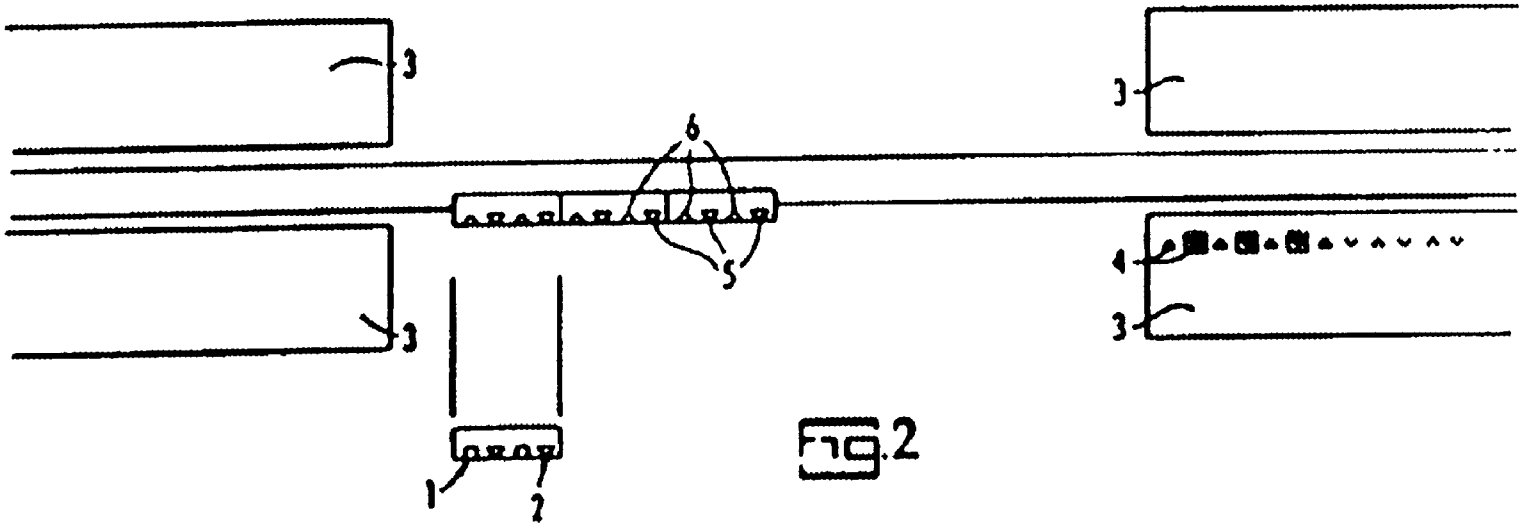
FIG. 2 shows an operating example with guidance systems in the filling and emptying region and in the means of transportation.

FIG. 2 indicate an operational example with a guidance system in the filling and emptying region and with a means of transportation with the track in the form of pairs 2.1 of rails, a means of transportation in the form of a train with a filling and emptying region as a termination of embarking and disembarking operation the platform doors of the gate means are closed and the subway train leaves the station.

FIG. 2 indicate an operational example with a guidance system in the filling and emptying region and with a means of transportation with the track in the form of pairs 2.1 of rails, a means of transportation in the form of a train with a filling and emptying region as a platform 2.3 with a guidance system with illuminated areas as a region definition 2.4, a guidance system in the means of transportation with illuminated areas as a dedication to disembark 2.5, a guide system with illuminated areas as a dedication for persons embarking 2.6.

In the present operational example during travel of the means of transportation 2.2 on the track 2.1 the detection means in the means of transportation detect the numerical individual flow rate in the means of transportation. Similarly the flow of individuals in the filling and emptying region 2.3 is determined. In the control means these values are employed to find out how the flow of individuals is distributed in the filling and emptying region and how the individuals in the means of transportation are best distributed. This distribution is interpreted via the command unit using the guidance systems in the means of transportation and in the filling and emptying region, since the corresponding illuminated areas in the filling and emptying region 2.4 are turned on in a manner dependent on whether same denote an embarking or a disembarking region, with the corresponding dedication. The illuminated areas of the guidance system point on the one hand toward the disembarking regions 2.5 and on the other hand toward the embarking regions 2.6.

Figure 3:
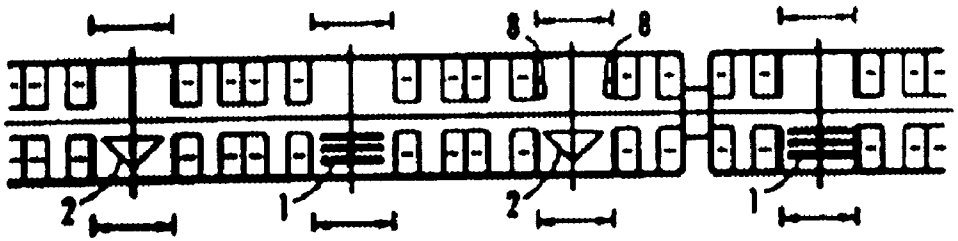
FIG. 3 shows the example of guidance system arrangement in the means of transportation.
Figure 4A:
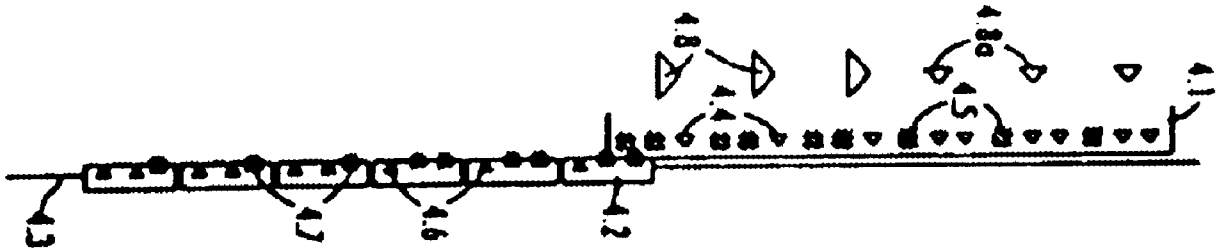
FIG. 4 shows the course of filling and emptying in four steps (4A through 4D).
Figure 4B:
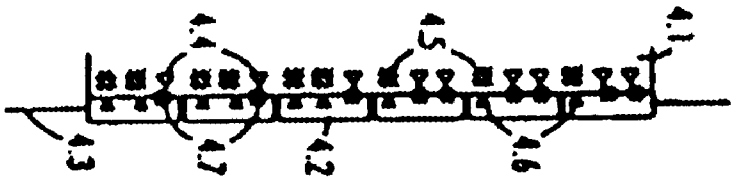
Figure 4C:
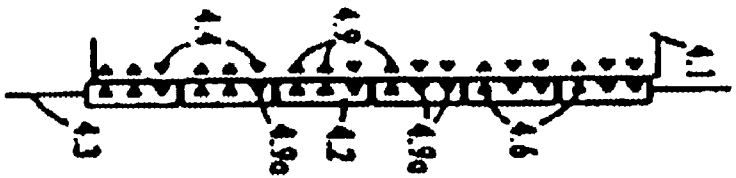
Figure 4D:
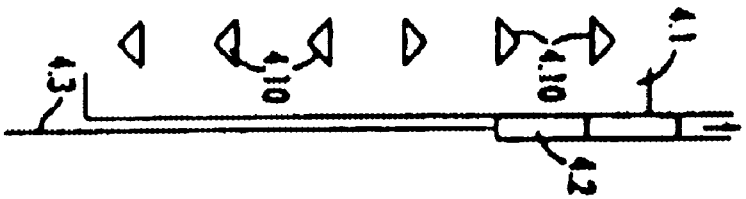

FIG. 3 shows a detailed view of a working example of the guidance system of the invention in a means of transportation with areas 1 dedicated for the persons embarking in the next station and with areas 3.2 dedicated for persons disembarking in the next station in a diagrammatic view and on a larger scale as a working example.

FIG. 4 shows a filling and emptying region as a platform 4.1, a means of transportation in the form of a train 4.2, a track in the form of rails 4.3, areas 4.4 with an embarking dedication, areas 4.5 to be kept free for disembarking, areas 4.6 for distribution in the train, areas 4.7 dedicated to be kept clear in the train, areas 4.8 dedicated to be used for distribution along the platform, areas 4.8*a* with a distribution dedication pointing toward the train, areas 4.9 dedicated to disembarking on the platform, areas 4.9*a* dedicated to embarking on the train and areas 4.10 with a dedication to clearing. On the arrival of the train in the station 4A the individuals or, respectively, passengers are distributed in the best possible manner on the platform using the areas 4.8 and 4.8*a,* it being assumed that more passengers are located in the lower region of the platform at the start of the distribution such distribution may also take place because in the lower, rear region of the train there are more passengers than in the front region. The areas 4.4 allot areas to passengers about to embark on the train. By means of the areas 4.5 the region are kept free, which the passengers need on leaving the train. In the train the passengers are directed by means of the areas 4.6 to the doors provided for disembarking. The areas 4.7 indicate the areas in the train to be kept free for the passengers embarking in the station. In accordance with 4B in the station after arrival of the train the areas 4.4 and 4.7 and also 4.5 and 4.6 are opposite each other. In accordance with 4C the dedications of the areas 4.5 are changed to 4.9 and 4.7 to 4.9*a* in order to indicate embarking and disembarking. In accordance with 4D the illuminated areas are turned off when the train leaves and the areas 4.10 guide the passengers from the platform. The previously described operation will be repeated any desired number of times in accordance with the individual stream.

Figure 5:
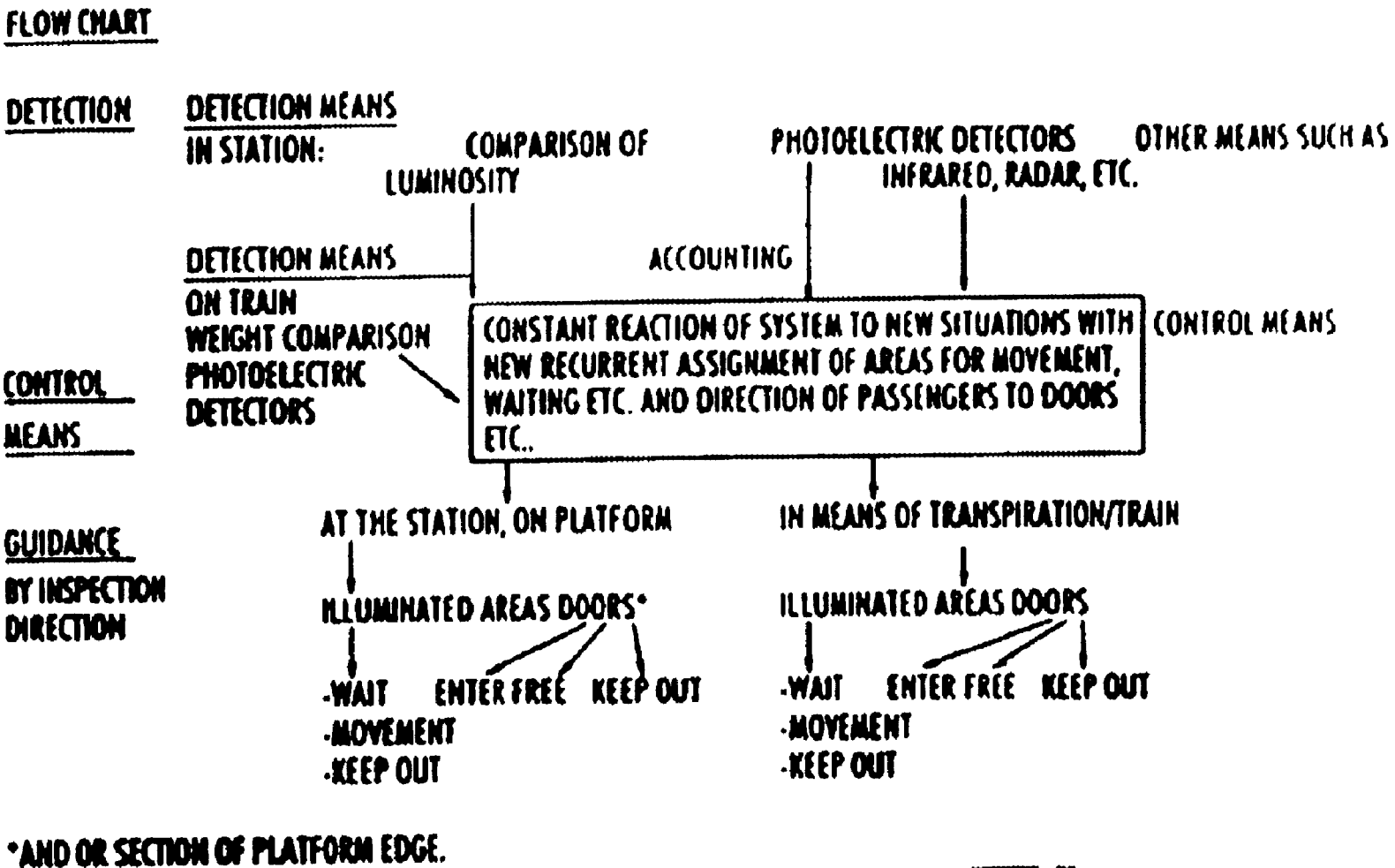
FIG. 5 shows a flow chart to indicate the method of the invention.

The flow chart depicted in FIG. 5 indicates by way of example the use of the device of the invention for implementing the method in accordance with the invention. Firstly the individual stream is detected by the detection means at the station and in the train. Detection means in the station means devices, which determine the numerical individual flow rate by comparing the intensity of illumination or by luminosity or by other means as for example infrared or radar or the like.

The detection means in the means of transportation, for example a train, can be the same as the detection means in the station, there being however in addition the possibility of determination by comparison of weight between the empty and the full train and preferably by photoelectric detectors 8. Similarly it is also possible to utilize seat sensors for detection. The information gathered by the detection means is supplied to the control means. Same reacts constantly to new situations, i.e. to constantly occurring changes in the individual stream by a new change in the dedication of the guidance systems, preferably of the areas, preferably illuminated areas for movement, waiting or the like and for passenger door allocation. Same is transmitted via the command means to the system guidance systems or, respectively, the gate means in the station or, respectively, on the platform and the guidance systems or, respectively, doors in the means of transportation or, respectively, in the train. The illuminated areas functioning as a guidance system in the station or, respectively, on the platform guide the individual stream, using the dedications "wait", move", do not enter" and "keep clear", preferably in every combination.

The illuminated areas functioning as a guidance system in the means of transportation or, respectively, the train receive the dedications "wait", "more", "keep free". The doors of the gate means or, respectively, of the means of transportation are opened or remain closed and, dependent on the dedication of the guidance system, serve for embarking and disembarking and preferably for separating filling and emptying and preferably embarking and disembarking.

What is claimed is:

1. A device for the guidance of individuals in streams in a traffic system to achieve an optimum distribution of the individuals in a traffic system and in filling and emptying regions of the system, comprising: a first guidance system in communication with filing and emptying regions; a second guidance system in communication with the traffic system, the traffic system including means of transportation; means for detecting the individuals in streams in the filling and emptying regions; means for detecting an individual flow rate in the means of transportation; a control means in communication with the first and the second guidance systems, and said the means for detecting the individuals in streams and the individual flow rate; optical means in communication with the first and the second guidance systems, the optical means having controlled illuminated areas; and, barrier means separating said filling and emptying regions from said means of transportation.

2. The device according to claim 1, wherein the illuminated areas are constructed such that their coloration, area sizes and forms may be varied.

3. The device according to claim 1, wherein the illuminated areas of the optical means are arranged in a floor of the filling and emptying regions, the illuminated areas comprising a transparent material which is suitable for being walked upon.

4. The device according to claim 1, wherein the illuminated areas of the optical means are in communication with an upper region of the barrier means.

5. The device according to claim 1, wherein the optical means comprises a matrix of individual lights which produce a plurality of displays, whereby the displays may vary in color, intensity and geometry in response to commands from the control unit such that the individuals are directed in an orderly fashion by the presentation of said displays.

6. The device according to claim 1, wherein said barrier means comprises vertical sheet-like structures arranged along a line between said filling and emptying regions and said means of transportation, said barrier means further having at least one section capable of being opened and closed by a drive means.

7. The device according to claim 6, wherein said barrier means is transparent.

8. The device according to claim 1, wherein said means for detecting individuals in streams and said flow rate comprises photoelectric means.

9. The device according to claim 1, wherein said means for detecting flow rate comprises a combination of light sources and sensors arranged in a floor and an elevated area of the filling and emptying regions, respectively, wherein a measurement of the amount of light that reaches the sensors from the light sources is indicative of a numerical individual flow rate.

10. The device according to claim 1, wherein said means for detecting the individuals in streams and the flow rate are arranged at an entry and an exit to and from the filling and emptying region, respectively.

11. A method for the control of individual streams in traffic systems having a means of transportation, and a platform having a filling region and an emptying region, comprising the steps of:

detecting an individual flow in the respective filling and emptying region and a numerical individual flow rate in the means of transportation;

processing data obtained in the step of detecting by a control unit and illuminating portions of said platform using combinations of colors and shapes to direct individual flows to said filling regions and away from said emptying region.

12. The method according to claim 11, wherein said control unit is capable of adapting the visual indications in response to changes in the individual streams in both the filling and emptying region and in the means of transportation.

* * * * *